United States Patent [19]

Merkel

[11] Patent Number: 4,821,995

[45] Date of Patent: Apr. 18, 1989

[54] CLIP FOR FLANGES OF FORMS IN FORMWORKS

[75] Inventor: Josef Merkel, Steinach, Fed. Rep. of Germany

[73] Assignee: Josef Maier, Steinach, Fed. Rep. of Germany

[21] Appl. No.: 225,730

[22] Filed: Jul. 28, 1988

[30] Foreign Application Priority Data

Jul. 28, 1987 [DE] Fed. Rep. of Germany ..... 3724872

[51] Int. Cl.[4] ..... E04G 17/04

[52] U.S. Cl. ..... 249/219.1; 24/524; 24/635; 249/47; 249/192; 269/234

[58] Field of Search ..... 249/6, 44, 45, 47, 192, 249/219.1; 254/104; 269/234; 24/239, 524, 526, 634, 635, 657

[56] References Cited

U.S. PATENT DOCUMENTS

| | | | |
|---|---|---|---|
| 838,611 | 12/1906 | Engeman | 24/239 |
| 1,593,610 | 7/1926 | White | 249/219.1 |
| 2,850,926 | 9/1958 | Jobe | 269/234 |
| 4,188,017 | 2/1980 | Dingler | 249/219.1 |
| 4,450,120 | 5/1984 | Maier | 264/31 |
| 4,520,990 | 6/1985 | Maier | 249/47 |
| 4,768,748 | 9/1988 | Leimkühler et al. | 249/192 |

FOREIGN PATENT DOCUMENTS 2759966 4/1986 Fed. Rep. of Germany .

*Primary Examiner*—Jay H. Woo
*Assistant Examiner*—James C. Housel
*Attorney, Agent, or Firm*—Peter K. Kontler

[57] ABSTRACT

A clip for abutting marginal flanges of forms for formworks which are used for the pouring of concrete has a cylindrical housing for two slidable arcuate clamping elements at opposite sides of a radially extending recess for the flanges. A wedge is movable between those end portions of the clamping elements which are remote from the recess to urge the elements against the exposed sides of the flanges. The wedge can be slidably coupled to the clamping elements so that it can urge the elements against or disengage the elements from the flanges in the recess.

29 Claims, 3 Drawing Sheets

CLIP FOR FLANGES OF FORMS IN FORMWORKS

BACKGROUND OF THE INVENTION

The invention relates to fastening devices in general, and more particularly to improvements in fastening devices (hereinafter called clips for short) which can be used with advantage to hold together two or more substantially plate-like components, such as the abutting marginal flanges of forms which are employed in formworks for the pouring of concrete or other building materials.

German patent No. 27 59 966 discloses a clip which is used to releasably engage open U-shaped flanges and employs two L-shaped clamping jaws. One leg of each jaw is parallel to the forms (when the clip is held in the operative position) to overlap the corresponding leg of the other jaw. The two legs must be fitted into each other.

A drawback of such clips is that the flanges of the forms must be provided with specially designed profiles which contribute to the cost of the formwork. Moreover, the clamping jaws are complex, bulky and expensive.

Certain other proposals include the provision of clips which employ bolts and nuts and/or magnets. Reference may be had, for example, to commonly owned U.S. Pat. Nos. 4,450,120 to Maier, 4,520,990 to Maier, 4,768,848 to Leimkühler et al.

OBJECTS OF THE INVENTION

An object of the invention is to provide a clip which is simpler, more compact and less expensive than, but is at least as reliable and versatile as, heretofore known clips.

Another object of the invention is to provide a clip which can be applied to existing forms of formworks for concrete or the like without necessitating any, or by necessitating only minor, changes of the flanges.

A further object of the invention is to provide a clip which is assembled of a relatively small number of simple parts and can be used to clamp portions of forms or like objects with a selected and variable force.

An additional object of the invention is to provide a clip wherein one and the same part can be used to engage it with or to disengage it from the components which are to be temporarily clamped to each other.

Still another object of the invention is to provide a clip which can be applied or deactivated by resorting to rudimentary tools.

A further object of the invention is to provide the clip with novel and improved clamping elements.

An additional object of the invention is to provide the clip with a novel and improved housing.

A further object of the invention is to provide the clip with novel and improved means for moving the clamping elements relative to the housing.

Another object of the invention is to provide a novel and improved method of separably fastening the marginal flanges of forms to each other.

An additional object of the invention is to provide a formwork for the pouring of concrete or other hardenable materials which employs one or more clips exhibiting the above outlined features.

A further object of the invention is to provide novel and improved forms which can be used with the above outlined clip.

Another object of the invention is to provide a clip which can be used jointly with or as a superior substitute for heretofore known fastening devices.

SUMMARY OF THE INVENTION

The invention is embodied in a clip for separably coupling to each other two preferably abutting substantially plate-like components, such as the marginal flanges or skirts of forms in a formwork for the pouring of concrete or other building materials. The improved clip comprises a housing having an inlet for the components, a pair of arcuate clamping elements which are installed in the housing at opposite sides of the inlet and have first portions adjacent the inlet and confronting second end portions, arcuate paths provided in the housing for movement of the clamping elements in directions to increase the mutual spacing of the first end portions while reducing the mutual spacing of the second end portions and vice versa, and means (preferably including a wedge) for moving the second end portions of the clamping elements apart so as to urge the first end portions of the clamping elements into clamping engagement with the components in the inlet of the housing.

The clip preferably comprises a housing which has a substantially circular outline and the inlet of such housing preferably extends substantially radially and has an open end in the periphery of the housing. Such open end can be provided in the housing substantially diametrically opposite the moving means. In accordance with a presently preferred embodiment, the housing has a peripheral wall having a substantially concave (preferably cylindrical) internal surface which defines portions of the paths for the clamping elements, and the inlet of such housing is preferably a recess with an open end in the peripheral wall of the housing. Such housing preferably further comprises two spaced-apart and preferably parallel end walls. The peripheral wall and the clamping elements are then disposed between the end walls, and at least one of the end walls has a slot constituting a portion of the recess or inlet in the housing. At least one of the end walls has an aperture for the moving means. Such aperture can constitute a slot, preferably an arcuate slot with a center of curvature coinciding with or being close to the center of curvature of one of the clamping elements. The center of curvature of the one clamping element preferably coincides with or is closely adjacent the center of curvature of the other clamping element. The moving means can comprise a wedge having an arcuate shape so that it can be slidably received in the arcuate aperture of the one end wall. The wedge is provided with two mutually inclined lateral surfaces which are adjacent the second end portions of the clamping elements, and the second end portions of such clamping elements preferably have surfaces which lie at least substantially flush against the adjacent lateral surfaces of the wedge, at least when the wedge maintains the first end portions of the clamping elements in clamping engagement with the components in the inlet of the housing. The surfaces of the second end portions of the clamping elements are preferably inclined relative to each other to such an extent and in such directions that their mutual inclination closely approximates or matches the mutual inclination of lateral surfaces of the wedge.

The outer side of at least one of the components which are to be coupled to each other can be provided with a protuberance, preferably with a convex or similar protuberance, and the first end portion of at least one of the clamping elements is then preferably formed with a socket (such as a concave socket) which is substantially complementary to and receives the protuberance.

The wedge preferably extends transversely of the housing and of the paths of movement of the clamping elements in the housing so that it projects beyond both end walls of the housing. The larger portion of the wedge is disposed at one side and the smaller portion of the wedge is located at the other side of the housing. The smaller portion of the wedge can be provided with one or more transversely extending pins, stubs, studs or like parts which prevent extraction of the wedge from the housing in a direction to move the smaller portion of the wedge into and thereupon out of the housing.

The housing preferably comprises arcuate channels which define the paths for the clamping elements. Those internal surfaces of the housing which bound the channels are preferably configurated in such a way that each channel has a square, rectangular or other polygonal cross-sectional outline. At least one of such internal surfaces is or can be substantially parallel to the planes of substantially plate-like components in the inlet of the housing. The end walls of the housing preferably extend at right angles to the planes of such components when the components are properly received in the inlet.

The housing preferably further comprises a preferably annular (arcuate) inner wall which is surrounded by the paths for the clamping elements and has a convex external surface which confronts and is spaced apart from the preferably concave internal surface of the peripheral wall of the housing.

As explained above, the lateral surfaces of the wedge can be maintained in sliding engagement with the complementary surfaces of the respective second end portions of the clamping elements. Alternatively, the wedge can be designed in such a way that it can move the second end portions of the clamping elements toward or away from each other, i.e., so that it can positively move the first end portions of the clamping elements against the components in the inlet of the housing and that it can also positively retract the first end portions of the clamping elements from the adjacent components in the inlet. To this end, the wedge and the second end portions of the clamping elements comprise means for slidably coupling the wedge to the second end portions. Such coupling means can comprise mutually inclined grooves in the second end portions of the clamping elements and mutually inclined beads which are provided on the wedge and extend into the adjacent grooves. The thickness of the beads (as measured radially of the clamping elements) preferably exceeds the thickness of the median portion of the preferably arcuate wedge, and the grooves of the second end portions of the clamping elements are preferably complementary to such beads. For example, each groove can have a substantially circular cross-sectional outline, and each bead can be received in the respective groove with some play to prevent jamming of the wedge.

The novel features which are considered as characteristic of the invention are set forth in particular in the appended claims. The improved clip itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
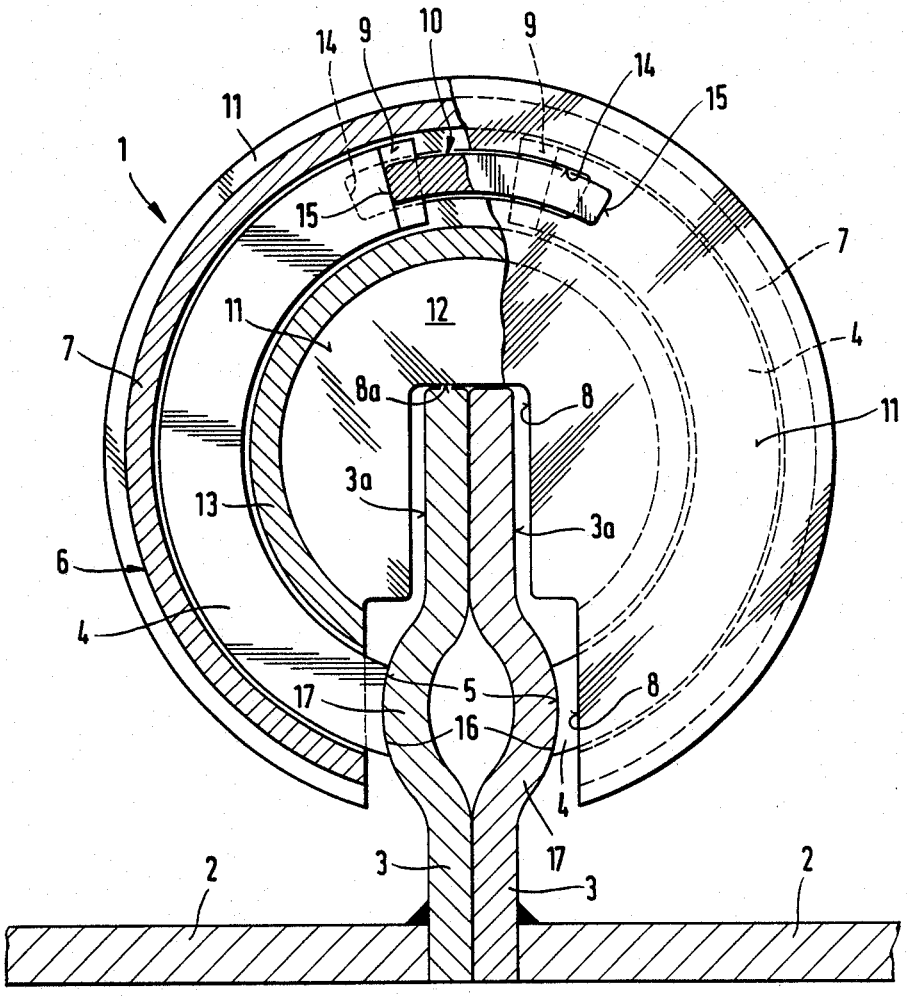
FIG. 1 is a partially plan and partially central sectional view of a clip which embodies the invention, two forms and their flanges being indicated by broken lines.
Figure 2:
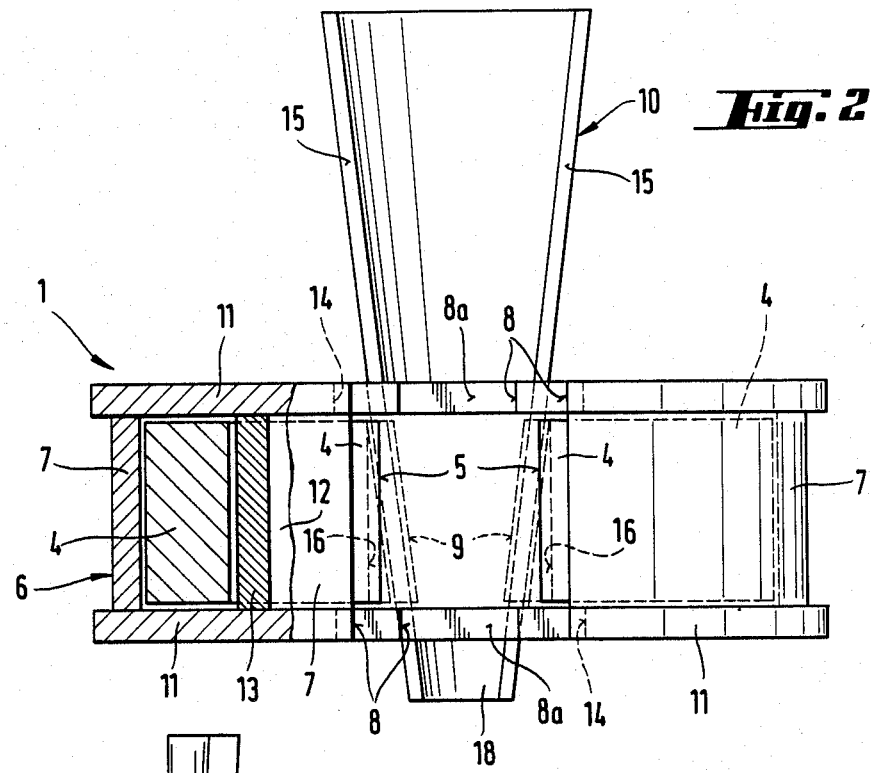
FIG. 2 is a front elevational view of the clip, with a portion of the housing and one of the clamping elements shown in a sectional view.
Figure 3:
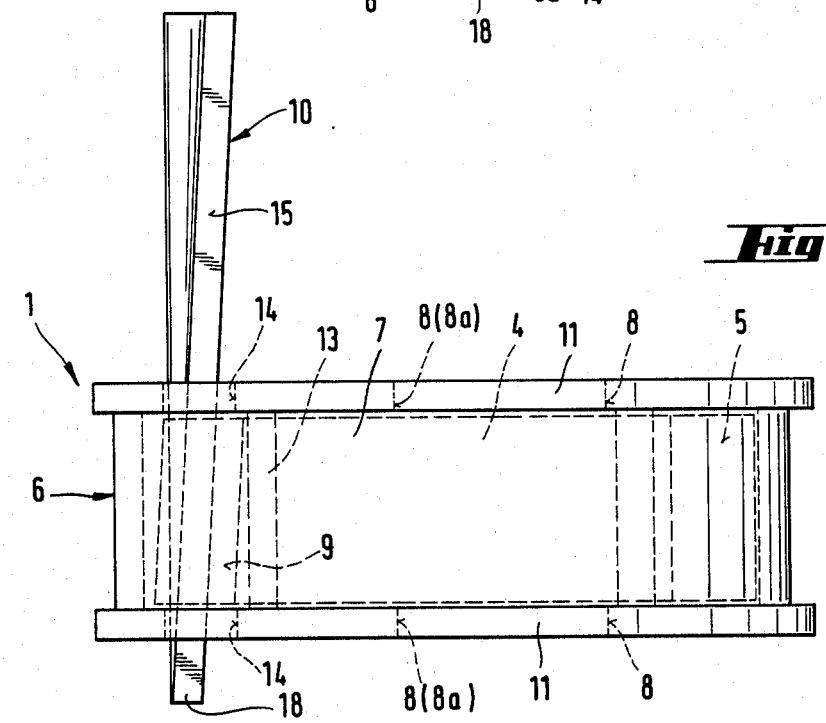
FIG. 3 is a side elevational view of the clip.

Referring first to FIGS. 1 to 3, there is shown a clip 1 which can be used to separably secure to each other two substantially parallel plate-like components 3. Each of these components can constitute a marginal flange of a discrete form 2, and the clip 1 can be used to maintain the forms 2 in a common plane (if the forms are flat plates or panels) by urging the adjacent sides of the flanges 3 toward each other with a variable force.

The clip 1 comprises a substantially round housing 6 which can be said to constitute a short cylinder and defines two arcuate paths for similarly curved clamping elements 4. The first end portions 5 of the clamping elements 4 (hereinafter called claws for short) can be biased against the outer sides 3*a* of the adjacent components (flanges) 3 by a wedge-like moving device 10 which can be driven between the second end portions 9 of the claws 4. Each of the illustrated claws 4 resembles or constitutes a portion of a ring, and the center of curvature of each of these claws can be located in or close to the axis of the housing 6. The latter is provided with an inlet 8 in the form of a radially extending recess which can receive the components 3 so that the outer sides 3*a* of such components are located between the end portions 5 of the claws 4 provided, of course, that the wedge-like moving device 10 is moved to a position in which the second end portions 9 of the claws can move sufficiently close to each other in order to provide between the end portions 5 room for the components 3.

The housing 6 comprises a substantially or exactly cylindrical peripheral wall 7 having a preferably cylindrical internal surface which surrounds two arcuate channels defining the aforementioned paths for the claws 4. The channels surround a substantially cylindrical inner wall 13 which, in turn, surrounds a centrally located chamber 12 of the housing 6. The latter further comprises two parallel end walls 11 at the opposite axial ends of the walls 7 and 13. The aforementioned inlet or recess 8 communicates with the centrally located chamber 12 and has an open outer end in the peripheral wall 7. The depth of the inlet or recess 8 is or can be selected in such a way that the exposed end faces of the properly inserted components 3 abut the surface 8*a* in the deepmost portion of the inlet. This ensures that the convex protuberances 17 of the outer sides 3*a* of the components 3 are properly aligned with each other and with the complementary concave sockets 16 in the first end portions 5 of the respective claws 4 so that portions of the protuberances 17 enter the respective sockets 16 when the moving device 10 is driven home in order to move the second end portions 9 apart while simultaneously moving the first end portions 5 nearer to each other.

FIG. 2 shows that the channels between the walls 7 and 13 of the housing 6 have a polygonal (substantially rectangular) cross-sectional outline and receive the respective claws 4 with a certain amount of play so as to ensure that the moving member 10 can readily displace the claws 4 in directions toward the outer sides 3*a* and protuberances 17 of the respective components 3 in the inlet 8 of the housing 6. The inlet 8 includes radially extending slots in the two end walls 11 of the housing 6 so that the components 3 can extend outwardly beyond the outer sides of these end walls, i.e., toward and away from the observer of FIG. 1. The width of the inlet 8 need not be constant; FIG. 1 shows that the radially outermost portion of the inlet 8 is wider so as to provide room for entry of the protuberances 17 and that the innermost portion of the inlet 8 is narrower so as to ensure adequate guidance of the outermost portions of the components 3 on their way toward abutment with the surface 8*a* (this is a composite surface including a first half in one of the end walls 11 and a second half in the other end wall 11). The first end portions 5 of the claws 4 extend outwardly beyond the respective channels in the housing 6 when their sockets 16 receive the respective protuberances 17.

The manner of operating the improved clip 1 will be readily comprehended upon perusal of the preceding description. Thus, when the wedge-like moving member 10 is held in the raised or retracted position of FIG. 3, the second end portions 9 of the claws 4 can move sufficiently close to each other to permit extraction of the components 3 from the inlet 8, i.e., the protuberances 17 can slide along the adjacent sockets 16 to move the first end portions 5 of the claws 4 apart so that the housing 6 can be slipped off the components 3 and/or the components 3 can be extracted from the inlet 8. If the clip 1 is to be reapplied to the components 3 or is to be applied to two different components 3 which are held in positions corresponding to those of the components 3 shown in FIG. 1, the housing 6 is moved to the position of FIG. 1 while the moving device 10 still dwells in or close to the position of FIG. 2 or 3 so that the end faces of the components 3 can be caused to abut the surface 8*a* in the inlet 8. The moving member 10 is then driven home (downwardly, as seen in FIG. 2 or 3) so that it moves the second end portions 9 of the claws 4 apart whereby the sockets 16 in the first end portions 5 snugly receive the respective protuberances 17 and thus ensure that the housing 6 cannot be slipped off the components 3 until and unless the moving device 10 is returned to, or moved close to, the position which is shown in FIGS. 2 and 3. The play between the claws 4 and the walls 7, 11, 11 and 13 of the housing 6 suffices to enable the moving member 10 to advance the claws 4 along their arcuate paths, and friction between the lateral surfaces 15 of the moving member 10 and the adjacent surfaces of the second end portions 9 of the claws 4 suffices to ensure that the position of the moving device 10 relative to the housing 6 and claws 4 cannot be changed accidentally, i.e., that it is necessary to apply a certain force in order to dislodge the moving device 10 in a direction to enable the second end portions 9 of the claws 4 to move nearer to each other.

The end walls 11 of the housing 6 are provided with preferably arcuate apertures or slots 14 for the wedge-like moving device 10. This moving device is an arcuate wedge with a center of curvature close to or coinciding with that of at least one of the claws 4. The same applies for the center of curvature of the apertures or slots 14 in the end walls 11. The inclination of the radially extending lateral surfaces 14 of the moving member 10 preferably approximates or matches the inclination of the exposed surfaces on the second end portions 9 of the claws 4 so that the end portions 9 can be maintained in surface-to-surface contact with the moving device 10 in all or nearly all positions of the moving device relative to the housing 6. This ensures that the moving device 10 is in large surface-to-surface contact with the claws 4 when the end portions 5 of the claws 4 bear against the outer sides 3*a* of the components 3 in the inlet 8 of the housing 6. Therefore, it is not necessary to lock the moving device 10 in a selected position relative to the housing 6 and claws 4. The smaller portion 18 of the moving device 10 can be provided with a transversely extending pin, stub, stud or a like part (not specifically shown) which prevents complete retraction of the portion 18 into the housing 6. This ensures that the moving device 10 cannot be completely separated from the housing 6 (and cannot be misplaced) except, of course, if an operator or another authorized person decides to remove the aforementioned stub, pin or stud.

The purpose of the inner wall 13 of the housing 6 is to ensure that the second end portions 9 of the claws 4 are always adjacent the respective lateral surfaces 15 of the moving device 10, i.e., that portions of the claws 4 cannot penetrate into the central chamber 12 of the housing 6. It will be seen that the wall 13 prevents excessive radially inward movements of the first end portions 5 and/or second end portions 9 of the claws 4, i.e., each claw is compelled to remain in its arcuate path which is bounded by the adjacent surfaces of the walls 7, 11, 11 and 13.

The protuberances 17 at the outer sides 3*a* of the components 3 and the complementary sockets 16 in the first end portions 5 of the claws 4 constitute optional but desirable features of the forms 2 and clip 1. An advantage of the protuberances 17 and sockets 16 is that the engagement between the claws 4 and the components 3 (when the moving device 10 is driven home) is not a mere frictional engagement but that the claws are then maintained in a highly satisfactory form-locking engagement with the respective components 3 to even further reduce the likelihood of accidental detachment of the clip 1 from the forms 2.

The aforementioned non-illustrated stub, stud or pin on the smaller portion 18 of the wedge-like moving device 10 also constitutes an optional feature of the improved clip 1. The distance of such stub, pin or stud from the other end of the moving device 10 can be selected in such a way that the operator knows that the inlet 8 is ready to receive a pair of abutting components 3 when the stub, pin or stud abuts the outer side of the adjacent end wall 11, i.e., the moving device 10 then permits the end portions 9 to move close to each other so that the end portions 5 do not interfere with insertion of components 3 into, or their extraction from, the inlet 8 of the housing 6.

The cross-sectional outlines of the channels for the arcuate claws 4 in the housing 6 can be varied without departing from the spirit of the invention. For example, the illustrated channels each of which has a rectangular cross-sectional outline can be replaced with channels having a square or other polygonal cross-sectional outline. The illustrated channels (or channels having square cross-sectional outlines) are preferred at this time because the surfaces which surround such channels invariably include two surfaces which are parallel to the forms 2 and/or their components 3. The substantially disc-shaped end walls 11 of the housing are disposed in two parallel planes which are normal or substantially normal to the planes of the components 3 when the clip 1 is properly applied to the forms 2.

An advantage of the improved clip 1 is that the two claws 4 can move independently of each other even though they can be moved into clamping engagement with the components 3 in the inlet 8 of the housing 6 by resorting to a single moving device 10. Moreover, the claws 4 can be moved toward engagement with the components 3 in synchronism by the simple expedient of driving the larger portion of the moving device 10 deeper into the housing 6. Arcuate claws 4 are preferred at this time because they can be mass-produced at a reasonable cost and can be readily guided along the respective arcuate paths in the housing 6. The claws 4 need not come into contact with and need not be guided by each other. This also contributes to simplicity and reliability of the improved clip.

Figure 4:
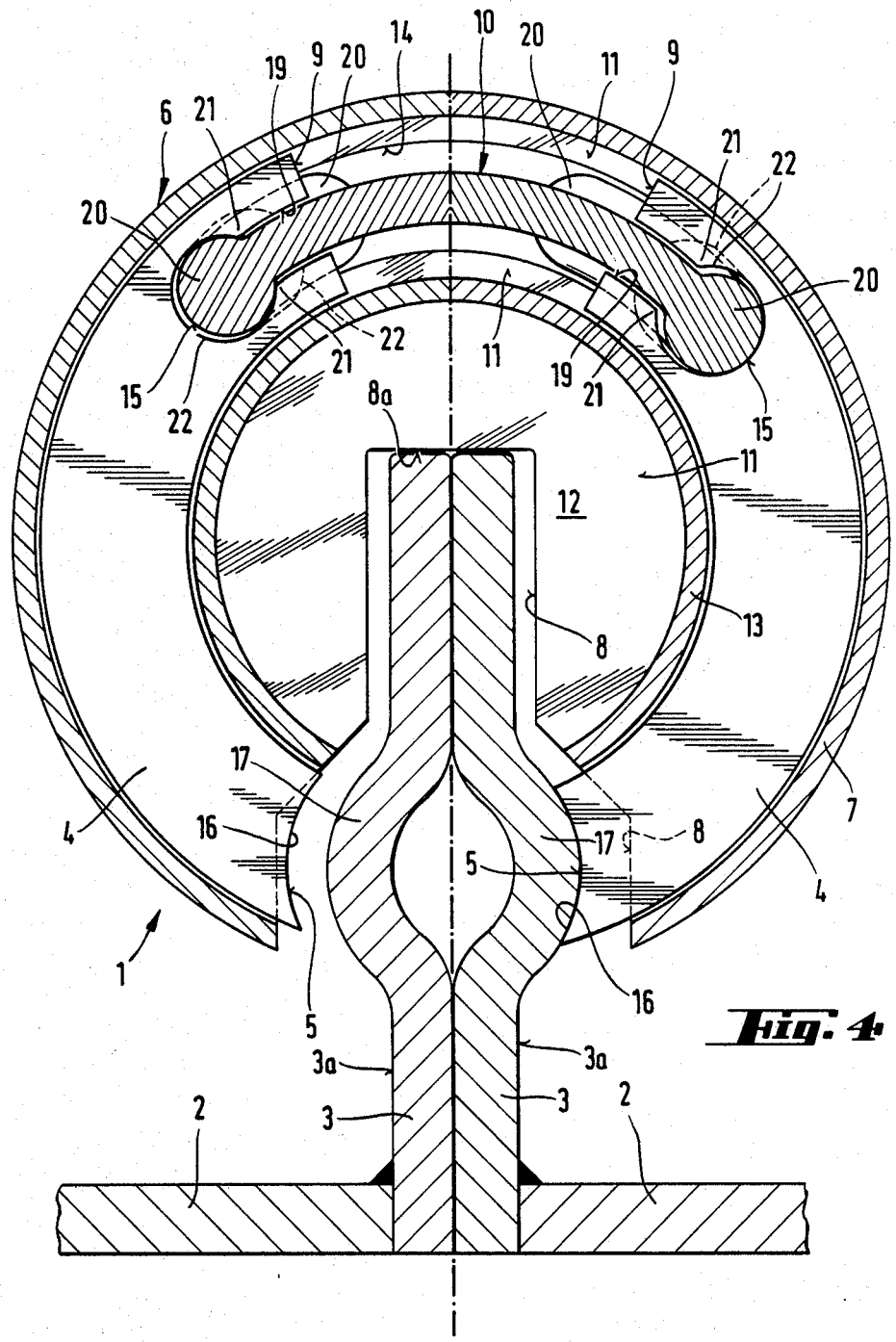
FIG. 4 is a central sectional view of a modified clip wherein the moving means is positively coupled to the clamping elements.

FIG. 4 shows a modified clip 1. All such parts of this clip which are identical with or clearly analogous to the corresponding parts of the clip of FIGS. 1–3 are denoted by similar reference characters. The first end portion 5 of the right-hand claw 4 of FIG. 4 is shown in the operative position of engagement with the protuberance 17 of the right-hand component 3, and the first end portion 5 of the left-hand claw 4 is shown in retracted position in which the left-hand component 3 can be withdrawn from the inlet 8 of the housing 6. In actual practice, both first end portions 5 will simultaneously engage, or will be simultaneously disengaged from, the respective protuberances 17.

An important difference between the clips of FIGS. 1–3 and FIG. 4 is that the clip 1 of FIG. 4 comprises a moving device 10 (again the form of an arcuate wedge or cam) which is more or less positively coupled to the second end portions 9 of the claws 4 so that the moving device 10 of FIG. 4 can serve as a means for moving the first end portions 5 toward the outer sides of the components 3 in the inlet 8 of the housing 6 and also as a means for retracting the first end portions 5 so that the components 3 can be withdrawn from the inlet 8. The coupling means between the moving device 10 and the second end portions 9 of the claws 4 can be said to establish a form-locking engagement between the bead-shaped longitudinally extending portions 20 of the device 10 and the surfaces bounding complementary grooves 22 in the end portions 9. The beads 20 provide the radially extending lateral surfaces 15 of the wedge-like moving device 10. The grooves 22 are preferably bounded by surfaces each of which has a substantially circular cross-sectional outline and each of which surrounds the respective bead 20 with a certain amount of play so as to ensure that the wedge-like moving device 10 can be readily shifted in a direction to move the end portions 9 apart and to thus engage the end portions 5 with the components 3 in the inlet 8, or vice versa. The beads 20 of the moving device 10 and the grooved end portions 9 of the claws 4 in the clip 1 of FIG. 4 reduce the likelihood of jamming of the moving device between the claws, especially during movement of the device 10 to the operative position in which the sockets of the first end portions 5 of the claws 4 receive the protuberances 17 of the respective components 3 in the inlet 8.

The diameters of the beads 20 exceed the thickness of the median portion of the wedge-like moving device 10 of FIG. 4. The longitudinally extending edges of the median portion of the device 10 are received in slots 19 which are provided in the exposed surfaces of the second end portions 19 and communicate with the respective grooves 22. It is clear that the end portions 9 of the claws 4 can be caused to form-lockingly engage the moving device 10 of FIG. 4 by providing such end portions with male coupling elements which extend into female coupling elements of the device 10. All that counts is to ensure that longitudinal displacement of the device 10 will entail a movement of the end portions 9 toward or away from each other, depending upon the direction of longitudinal movement of the device 10.

The right-hand bead 20 of the moving device 10 of FIG. 4 is shown in the deepmost portion of the respective groove 22 so that the clearance between the second end portion 9 of the right-hand claw 4 and the device 10 along the convex surface of the right-hand bead 20 is zero. The undercut portions 21 of the right-hand bead 20 are remote from the shoulders in the groove 22 of the right-hand end portion 9. The left-hand bead 20 of FIG. 4 is shown in that position relative to the corresponding groove 22 in which it can pull the left-hand end portion 9 in a direction to disengage the end portion 5 of the left-hand claw 4 from the protuberance 17 on the left-hand component 3 in the inlet 8 of the housing 6. A hammer or any other rudimentary tool can be used to move the wedge-like moving member 10 of FIG. 4 in the desired direction, i.e., to move the end portions 5 into engagement with the components 3 in the inlet 8 or to disengage the end portions 5 from the respective protuberances 17.

Grooves 20 having circular cross-sectional outlines and complementary beads 20 are preferred at this time because they can be produced at a reasonable cost. However, it is equally possible to employ beads and to form grooves whose configuration departs from those shown in FIG. 4. It will be readily appreciated that some, or even substantial, tolerances between the beads 20 and the adjacent internal surfaces of the second end portions 9 of the claws 4 do not affect the operativeness and/or utility of the improved clip 1. The provision of relatively deep slots 19 which extend from the end faces of the second end portions 9 of the claws 4 of FIG. 4 into the respective grooves 22 is desirable and advantageous because this ensures that the respective marginal portions of the median portion of the arcuate wedge-like moving member 10 are adequately guided in the slots 19 so that the device 10 is even less likely to jam in the end portions 9 during movement in a direction to shift the end portions 5 toward or away from each other.

The configuration of the housing 6 can depart from that which is shown in FIGS. 1 to 4. A substantially cylindrical housing is preferred at this time because it can be produced at a reasonable cost and occupies a minimal amount of space in storage or in actual use. Moreover, the aforementioned concave internal surface of the peripheral wall 7 of the cylindrical housing 6 can cooperate with the convex external surface of the inner wall 13 to establish two arcuate channels for proper guidance of the similarly curved claws 4. The walls 7, 13 ensure that the claws 4 move in synchronism toward or away from their positions of engagement with the respective components 3 in the inlet 8 of the housing 6.

The wedge-like moving device 10 constitutes a presently preferred means for changing the positions of the claws 4 relative to the housing 6.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A clip for separably coupling to each other two substantially plate-like components, said clip comprising a housing having an inlet for the components; a pair of arcuate clamping elements installed in said housing at opposite sides of said inlet and having first end portions adjacent said inlet and confronting second end portions, said housing defining arcuate paths for sliding movement of said elements in directions to increase the mutual spacing of said first end portions while reducing the mutual spacing of said second end portions and vice versa; and means for moving the second end portions of said elements apart so as to urge said first end portions into clamping engagement with the components in said inlet.

2. The clip of claim 1, wherein said housing has a substantially circular outline and said inlet is a substantially radial recess having an open end in the periphery of said housing.

3. The clip of claim 2, wherein said open end is provided in said housing substantially diametrically opposite said moving means.

4. The clip of claim 1, wherein said moving means includes a wedge.

5. The clip of claim 1, wherein said housing includes a peripheral wall having a substantially cylindrical internal surface defining portions of said paths, said inlet constituting a recess having an open end in said peripheral wall.

6. The clip of claim 5, wherein said housing further includes two end walls, said peripheral wall and said clamping elements being disposed between said end walls and said recess having a portion in at least one of said end walls.

7. The clip of claim 6, wherein said moving means includes a wedge and at least one of said end walls has an aperture for a portion of said wedge.

8. The clip of claim 7, wherein said aperture is a slot.

9. The clip of claim 7, wherein said arcuate clamping elements have centers of curvature which are close to or coincide with each other, said aperture having an arcuate shape with a center of curvature close to or coinciding with the center of curvature of at least one of said elements.

10. The clip of claim 9, wherein said wedge has an arcuate shape.

11. The clip of claim 1, wherein said moving means includes a wedge having mutually inclined lateral surfaces adjacent the second end portions of said clamping elements and the second end portions of said clamping elements have surfaces which lie at least substantially flush against the respective lateral surfaces of said wedge, at least when said wedge maintains the first end portions of said elements in clamping engagement with the components in said inlet.

12. The clip of claim 11, wherein said surfaces of the second end portions of said clamping elements are inclined relative to each other and their mutual inclination closely approximates or matches the mutual inclination of said lateral surfaces.

13. The clip of claim 1, for separably coupling to each other two components having outer sides at least one of which is provided with a protuberance, wherein at least one of said first end portions has a socket for the protuberance of the adjacent component in said inlet.

14. The clip of claim 1 for separably coupling to each other two abutting components having outer sides at least one of which is provided with a substantially convex protuberance, wherein at least one of said first end portions has a concave socket which is substantially complementary to and receives the convex protuberance of the one component in said inlet.

15. The clip of claim 1, wherein said moving means includes a wedge extending transversely of said housing between the second end portions of said clamping elements and having a larger portion at one side and a smaller portion at the other side of said housing.

16. The clip of claim 15, wherein the smaller portion of said wedge has a means for preventing extraction of the wedge from said housing.

17. The clip of claim 1, wherein said housing has arcuate channels which define said paths.

18. The clip of claim 17, wherein said housing has internal surfaces bounding said channels and each of said channels has a polygonal cross-sectional outline.

19. The clip of claim 17, wherein said housing has end walls which are disposed at right angles to planes defined by the plate-like components in said inlet.

20. The clip of claim 17, wherein said housing has internal surfaces bounding said channels and including at least one surface which is substantially perpendicular to the plate-like components in said inlet.

21. The clip of claim 1, wherein said housing includes a peripheral wall having a concave internal surface which is adjacent said clamping elements and a substantially arcuate inner wall having a convex external surface which is surrounded by said clamping elements.

22. The clip of claim 21, wherein said housing has an internal chamber which is surrounded by said inner wall and communicates with said inlet.

23. The clip of claim 1, wherein said moving means includes means for moving the second end portions of said clamping elements toward and away from each other.

24. The clip of claim 23, wherein said moving means includes a wedge which is movable transversely of said housing, said wedge and the second end portions of said clamping elements having means for slidably coupling said wedge to said second end portions.

25. The clip of claim 24, wherein said coupling means comprises mutually inclined grooves which are provided in said second end portions and mutually inclined beads provided on said wedge and extending into said grooves.

26. The clip of claim 25, wherein the wedge includes a median portion having a first thickness as measured radially of said arcuate clamping elements and said beads have thicknesses exceeding the thickness of said median portion.

27. The clip of claim 26, wherein said grooves are substantially complementary to said beads.

28. The clip of claim 25, wherein said grooves have substantially circular cross-sectional outlines.

29. The clip of claim 26, wherein said beads are reciprocable with play in the respective grooves.

* * * * *